United States Patent [19]

Molnes

[11] Patent Number: 4,662,302

[45] Date of Patent: May 5, 1987

[54] SEMI-SUBMERSIBLE OFFSHORE VESSEL

[75] Inventor: Arnfinn Molnes, Nol, Sweden

[73] Assignee: Götaverken Arendal AB, Gothenburg, Sweden

[21] Appl. No.: 639,932

[22] Filed: Aug. 13, 1984

[30] Foreign Application Priority Data

Sep. 7, 1983 [SE] Sweden ..... 8304793

[51] Int. Cl.[4] ..... B63B 35/44

[52] U.S. Cl. ..... 114/265

[58] Field of Search ..... 114/264, 265, 266, 267, 114/263, 61, 123, 125; 405/196, 200; 166/352

[56] References Cited

U.S. PATENT DOCUMENTS

| | | | |
|---|---|---|---|
| 3,610,193 | 10/1971 | Lacy et al. | 114/265 |
| 3,686,886 | 8/1972 | Georgii | 114/264 |
| 3,874,314 | 4/1975 | Sanders | 114/265 |
| 4,232,625 | 11/1980 | Goren et al. | 114/61 |

FOREIGN PATENT DOCUMENTS

| | | | |
|---|---|---|---|
| 2641040 | 3/1978 | Fed. Rep. of Germany | 114/264 |
| 1067339 | 5/1967 | United Kingdom | 114/125 |
| 2068319 | 8/1981 | United Kingdom | 114/125 |
| 2084529 | 4/1982 | United Kingdom | 114/265 |

*Primary Examiner*—Trygve M. Blix
*Assistant Examiner*—Jesûs D. Sotelo
*Attorney, Agent, or Firm*—Wegner & Bretschneider

[57] ABSTRACT

In order to reduce the risk of an offshore vessel capsizing in the event of a collision resulting in damage to its columns, a strengthening member is arranged in front of at least one of the columns, between the work platform of the vessel and the supporting hull. The strengthening member comprises a watertight box structure rigidly connected to the platform, and a tubular, also displacing part, extending between the box structure and the hull. The box structure has considerable volume and is situated so high that it will not be damaged in the event of a collision.

6 Claims, 1 Drawing Figure

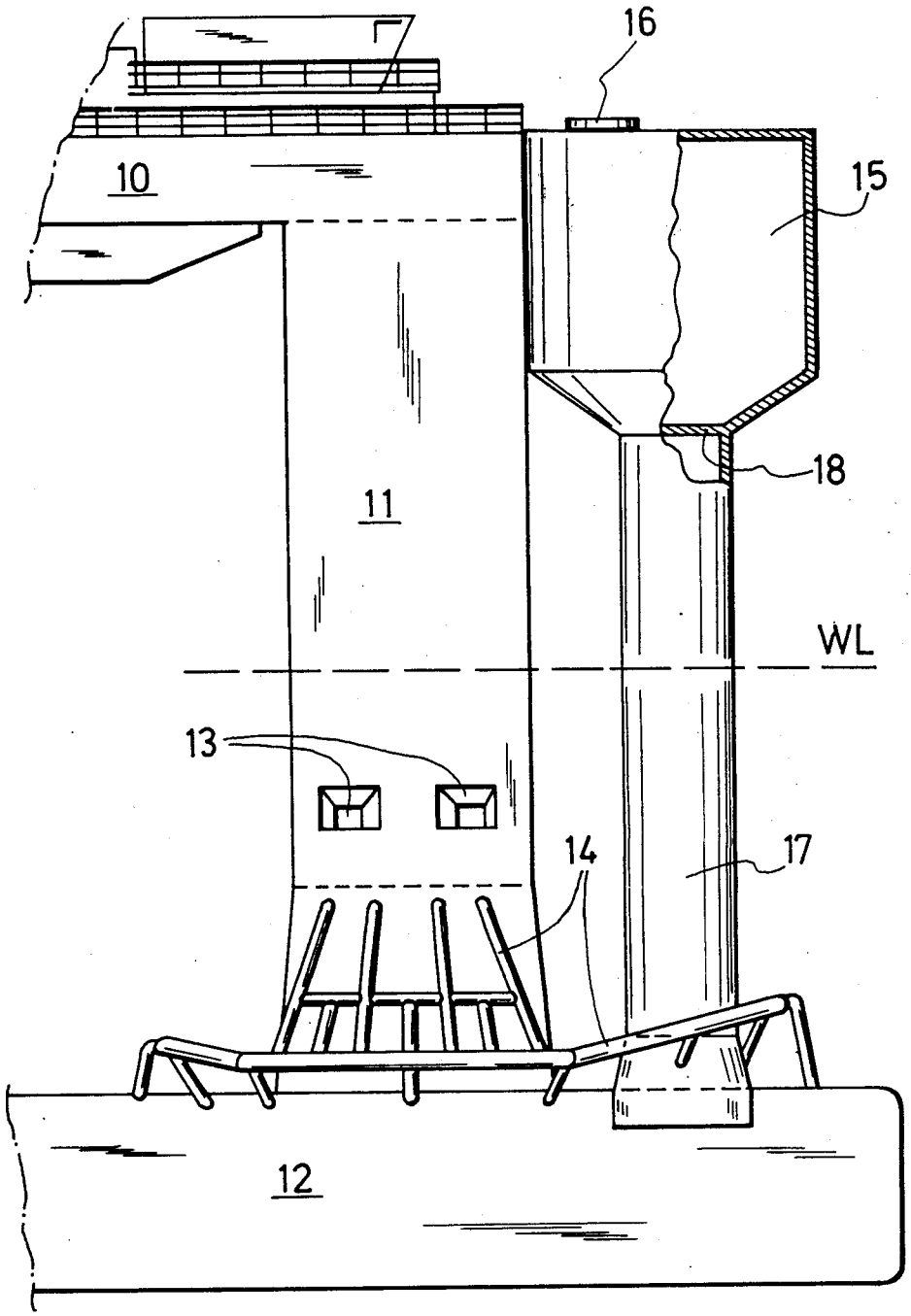
16
10
15
18
11
WL
13
14
17
12

SEMI-SUBMERSIBLE OFFSHORE VESSEL

BACKGROUND OF THE INVENTION

Semi-submersible offshore vessels used for oil production and for accomodation mainly comprise a work platform, carried by means of four or more columns resting on underwater hulls. The columns can be damaged during a collision with another vessel, or some large floating object, like an iceberg. As the columns, at least partly, are used for vertical communication, there will be a loss of displacing capacity if a column become water filled. There is then an apparent risk that the vessel will capsize, or at least will heel over so much, that a rescue operation will be difficult to carry out.

The object of the present invention is to propose an arrangement, which generally will improve the stability of the vessel and which gives a good margin of safety from capsizing in an event of disaster. The invention facilities rebuilding of old vessels.

SUMMARY OF THE INVENTION

A semi-submersible vessel comprises at least four columns, usually carried by two parallel undewater hulls, but there are also vessels with a large number of columns, and in certain cases each column rests on a hull of its own.

A device according to the invention is preferably attached to each corner of a vessel with four columns, but can obviously be affixed to all columns, if more than four columns are used.

A device according to the invention is characterized by a strengthening member fitted in front of at least one of the columns, between an underwater hull and the platform, and comprising a downwardly closed box structure, which is rigidly connected to the platform and located above nomral operating water line.

The box structure preferably has a larger sectional area than that of the adjacent column.

The strengthening member preferably comprises a tubular component standing between the box structure and the hull, and it is designed as a displacing body.

BRIEF DESCRIPTION OF THE DRAWING

The accompanying drawing shows a part of a semi-submersible offshore vessel, having a strengthening member according to the invention.

DETAILED DESCRIPTION

The drawing showing a corner part of an offshore vessel comprising a work deck 10, which carries the necessary equipment, and is supported by columns 11, which stand on underwater hulls 12.

The columns are in the normal way equiped with openings 13 for chain boxes—anchors not shown in the drawing normally rest on guard railings 14. Within each column there are vertical passages connecting the platform with the underlying hull, and in spite of internal watertight bulkheads with closeable hatches, there is always a considerable risk that damage by collision onto the steel plating of a column may result in a major part of the column, and also perhaps the hull, being filled with water, which brings about a loss of displacement.

In order to meet these risks a strengthening member is arranged in front of each column, where there is a risk of damage—in the case of four columns supported by two parallel hulls there will be one strengthening member in front of each column.

The strengthening member comprises one upper box structure 15, which is completely closed downwards, and has a considerable displacement. In the deck there is a closeable manhole cover 16. The box structure has a cross section noticeably larger than the corresponding area of the column, and is situated so high above the operating waterline (WL), that there is no risk of being damaged during possible collision. The box structure 15 is rigidly connected to the platform 10.

A tubular element 17 extends between the box structure 15 and the hull 12, which tubular element also is designed as a displacing body, but is separated from the box structure by a watertight bulkhead 18.

The tubular element 17 will normally increase the stability of the vessel through its position outside the column 11, but there is also a risk that this element can be filled with water in an event of collision. The box structure 15 must therefore have the necessary volume to carry the corner of the platform until measurements can be taken for changing the trim and for rescuing activities.

The embodiment shown in the drawing is merely an example of the invention, and the components thereof may be varied in different ways within the scope of the accompanying claims.

What I claim is:

1. In a semi-submersible offshore vessel of the kind including a work platform carried by a number of columns supported by underwater hulls, the improvement of a strengthening member fitted outboard of at least one of said columns, extending between the associated undewater hull and said platform, and comprising a portion adjoining the column and forming a downwardly closed box structure having a larger cross sectional area than the adjoining column and being above normal operating water line, said strengthening member being rigidly connected to said platform and said associated hull.

2. An offshore vessel as claimed in claim 1, wherein the lower portion of said strengthening member comprises a tubular member of lesser cross-sectional area than said box structure, and designed as a displacing body separate from said box structure.

3. A semi-submersible offshore vessel comprising:

a rectangular work platform having at least four columns, one located at each corner, supported by underwater hulls;

a strengthening member fitted outboard of each of said four columns, extending between the associated underwater hull and said platform, and comprising a portion adjoining the associated column and forming a downwardly closed box structure having a larger cross sectional area than the adjoining column and being above normal operating water line, said strengthening member being rigidly connected to said platform and said associated hull.

4. An offshore vessel as claimed in claim 3, wherein the lower portion of said strengthening member comprises a tubular member of lesser cross-sectional area than said box structure, and designed as a dispacing body separate from said box structure.

5. A semi-submersible offshore vessel, comprising:

a platform having columns supported by underwater hulls;

a first displacing body having a closed box structure adjoining said platform adjacent one of said columns and fixedly attached to at least said platform, said first displacing body being larger in cross section than the adjacent column and located above normal operating water line;

a second displacing body extending from said first displacing body and fixedly attached to one of said underwater hulls, said second displacing body being tubular in shape and having a smaller cross section than said first displacing body.

6. A semi-submersible offshore vessel as claimed in claim 5, wherein the first displacing body is located high enough above the normal operating water line that it will not be damaged during a possible collision with another vessel.

* * * * *